US008371573B2

(12) United States Patent
Morikawa et al.

(10) Patent No.: US 8,371,573 B2
(45) Date of Patent: Feb. 12, 2013

(54) FEEDING DEVICE

(75) Inventors: Shuichi Morikawa, Ishikawa (JP); Masao Takayama, Ishikawa (JP); Hideyuki Okumura, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 13/029,498

(22) Filed: Feb. 17, 2011

(65) Prior Publication Data

US 2011/0133394 A1 Jun. 9, 2011

Related U.S. Application Data

(62) Division of application No. 12/248,920, filed on Oct. 10, 2008, now Pat. No. 7,913,994.

(30) Foreign Application Priority Data

Apr. 9, 2008 (JP) ..... 2008-101109

(51) Int. Cl.
*B65H 3/52* (2006.01)

(52) U.S. Cl. ..... 271/121; 271/122; 271/124; 271/125; 271/165; 271/167; 271/21; 271/23

(58) Field of Classification Search ..... 271/21, 271/23, 121, 122, 165, 167, 124, 125
See application file for complete search history.

(56) References Cited

U.S. PATENT DOCUMENTS 5,088,715 A 2/1992 Shibata et al.
5,118,091 A * 6/1992 Nagamoto et al. ..... 271/122
5,570,876 A 11/1996 Samii
5,584,475 A 12/1996 Asada et al.
5,727,782 A 3/1998 Okada
6,000,689 A * 12/1999 Furuki et al. ..... 271/10.11
6,059,281 A * 5/2000 Nakamura et al. ..... 271/119
6,318,716 B1 11/2001 Okuda
6,371,477 B1 4/2002 Lin
6,585,250 B1 7/2003 Hsiao
6,672,580 B2 * 1/2004 Shibata et al. ..... 271/124
7,128,316 B2 10/2006 Nakano et al.
7,419,155 B2 * 9/2008 Stoll et al. ..... 271/131
7,806,402 B2 * 10/2010 Sato et al. ..... 271/165
7,992,860 B2 * 8/2011 Kimura et al. ..... 271/121

(Continued)

FOREIGN PATENT DOCUMENTS

JP 59153732 A * 9/1984
JP 02282124 A * 11/1990

(Continued)

OTHER PUBLICATIONS

Japanese Office Action for Application No. JP2008-101109 mailed May 18, 2012.

*Primary Examiner* — Prasad Gokhale
(74) *Attorney, Agent, or Firm* — Lowe Hauptman Ham & Berner LLP

(57) ABSTRACT

A feeding device includes a tray for stacking sheet-like conveyance-target media, a first pressing unit, and a second pressing unit. The first and second pressing units face and apply a first and second pressing force, respectively, on a circumferential surface of a pick roller so that a first contact area and a second contact area overlap each other. The first pressing unit includes a first pressing unit separation roller, and the first contact area is defined wherein the first pressing unit and the pick roller make contact with each other. The second contact area is defined wherein the second pressing unit and the pick roller make contact with each other such that the first contact area and the second contact appear to partly overlap each other when viewed from an axial direction of the pick roller.

10 Claims, 8 Drawing Sheets

U.S. PATENT DOCUMENTS

| | | | | |
|---|---|---|---|---|
| 2003/0107165 | A1 * | 6/2003 | Werner et al. | 271/121 |
| 2004/0212141 | A1 * | 10/2004 | Graef et al. | 271/121 |
| 2006/0255526 | A1 | 11/2006 | Ginzton | |

FOREIGN PATENT DOCUMENTS

| | | | |
|---|---|---|---|
| JP | 04088440 | U | 7/1992 |
| JP | 618344 | | 3/1994 |
| JP | 08002724 | | 1/1996 |
| JP | 2001-063854 | A | 3/2001 |
| JP | 2003072970 | | 3/2003 |
| JP | 2004075242 | A | 3/2004 |
| JP | 2004123359 | A | 4/2004 |

* cited by examiner

FEEDING DEVICE

RELATED APPLICATIONS

This is a Divisional Application of U.S. application Ser. No. 12/248,188, filed on Oct. 10, 2008, which is based on, and claims priority from Japanese Application Number 2008-101109, filed Apr. 9, 2008. The content of all above applications are hereby incorporated by reference in their entirety.

BACKGROUND OF THE INVENTION

1. Field of the Invention

The present invention relates to a feeding device that conveys a sheet-like conveyance-target medium toward, for example, an image pickup unit provided to an image reading apparatus or an image forming unit provided to an image forming apparatus.

2. Description of the Related Art

A feeding device has been suggested that conveys a paper sheet, which is a sheet-like conveyance-target medium, toward, for example, an image pickup unit provided to an image reading apparatus or an image forming unit provided to an image forming apparatus.

In such a feeding device, among sheet-like conveyance-target media stacked on a tray, when a conveyed medium that becomes in contact with a pick roller in a rotating state is pressed onto a circumferential surface of the pick roller by a pressing unit, such as a separation roller, a conveyance force for sending the conveyed medium toward a conveyance destination, such as an imaging unit, is acted from the pick roller to the conveyed medium. With this, the conveyed medium is sent toward the imaging unit or the like. If a separation-target medium, which is placed on the conveyed medium but is not a conveyance target, is left, the pressing unit, such as a separation roller, makes contact with the separation-target medium to cause a separation force smaller than the conveyance force to be acted on this conveyed medium in a direction opposite to the conveyance force. With this, the separation-target medium is moved oppositely to the conveyed medium being sent by the pick roller in a sending direction. As a result of this opposite movement, when overlapping of the conveyed medium and the separation-target medium is eliminated, in other words, when the separation-target medium is separated from the conveyed medium, only the conveyed medium, that is, one conveyance-target medium, is conveyed to the conveyance destination, such as the imaging unit.

To improve the capability of separating the conveyed medium and the separation-target medium, a feeding device is suggested in which two separation rollers are disposed along a direction in which a pick roller rotates (for example, refer to Japanese Patent Application Laid-open Publication No. 2004-75242 and Japanese Patent Application Laid-open Publication No. 2004-123359). If the conveyed medium and the separation-target medium cannot be separated by one of the separation rollers on an upstream side along a rotating direction of a pick roller, a separation force is further acted by the other one of the separation rollers on a downstream side onto the conveyed medium and a conveyance-target medium, which is the separation-target medium, to separate the conveyed medium and the separation-target medium.

However, in the feeding device disclosed in Japanese Patent Application Laid-open Publication No. 2004-75242 or Japanese Patent Application Laid-open Publication No. 2004-123359, the separation-target medium overlapping the conveyed medium does not receive a pressing force onto the circumferential surface between the separation roller on the upstream side and the separation roller on the downstream side along the direction in which the pick roller rotates. Therefore, if the conveyed medium and the separation-target medium are not separated by the separation roller on the upstream side, when the separation-target medium is sent to the separation roller on the downstream side, the separation-target medium receives a separation force from the separation roller on the downstream side to be bent between the separation roller on the upstream side and the separation roller on the downstream side, thereby possibly causing a conveyance jam.

SUMMARY OF THE INVENTION

It is an object of the present invention to at least partially solve the problems in the conventional technology.

According to an aspect of the present invention, a feeding device includes a tray on which sheet-like conveyance-target media are stacked; a pick roller that acts a conveyance force onto one conveyed medium, which is a conveyance target in contact with the pick roller among the stacked conveyance-target media, to send the contacting conveyed medium toward a conveyance destination, the conveyance force causing the conveyed medium to be sent toward the conveyance destination with a pressing force being applied via the conveyed medium to a circumferential surface of the pick roller in a rotating state; a first pressing unit, disposed to face and make contact with the circumferential surface of the pick roller and making contact with one of the conveyance-target media that is either one of the conveyed medium and a separation-target medium that is placed on the conveyed medium and is not a conveyance target, for pressing the conveyance-target medium onto the circumferential surface of the pick roller to apply a first pressing force onto the circumferential surface of the pick roller, and acting a first separation force smaller than the conveyance force onto the contacting conveyance-target medium, which is either one of the conveyed medium and the separation-target medium, in a direction opposite to a direction of the conveyance-force; a second pressing unit, disposed on a downstream side of the first pressing unit along a direction in which the pick roller rotates to face and make contact with the circumferential surface of the pick roller and making contact with the conveyance-target medium which is either one of the conveyed medium and the separation-target medium and sent by the pick roller toward the conveyance destination, for pressing the conveyance-target medium onto the circumferential surface of the pick roller to apply a second pressing force onto the circumferential surface of the pick roller, and acting a second separation force smaller than the conveyance force onto the contacting conveyance-target medium, which is either one of the conveyed medium and the separation-target medium, in the direction opposite to the direction of the conveyance force; and a rotation driving unit that drives the pick roller for rotation. Further, the first pressing unit and the second pressing unit are disposed along the direction in which the pick roller rotates so that a first contact area, in which the first pressing unit and the pick roller make contact with each other, and a second contact area, in which the second pressing unit and the pick roller make contact with each other, overlap each other.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 13 is a drawing in which FIG. 11 is modeled, assuming that a conveyance-target medium linearly moves on the pick roller.

DETAILED DESCRIPTION OF THE PREFERRED EMBODIMENTS

Embodiments of the feeding device according to the present invention are explained in detail below based on the drawings. Note that the following embodiments are not meant to restrict the present invention.

Figure 1:
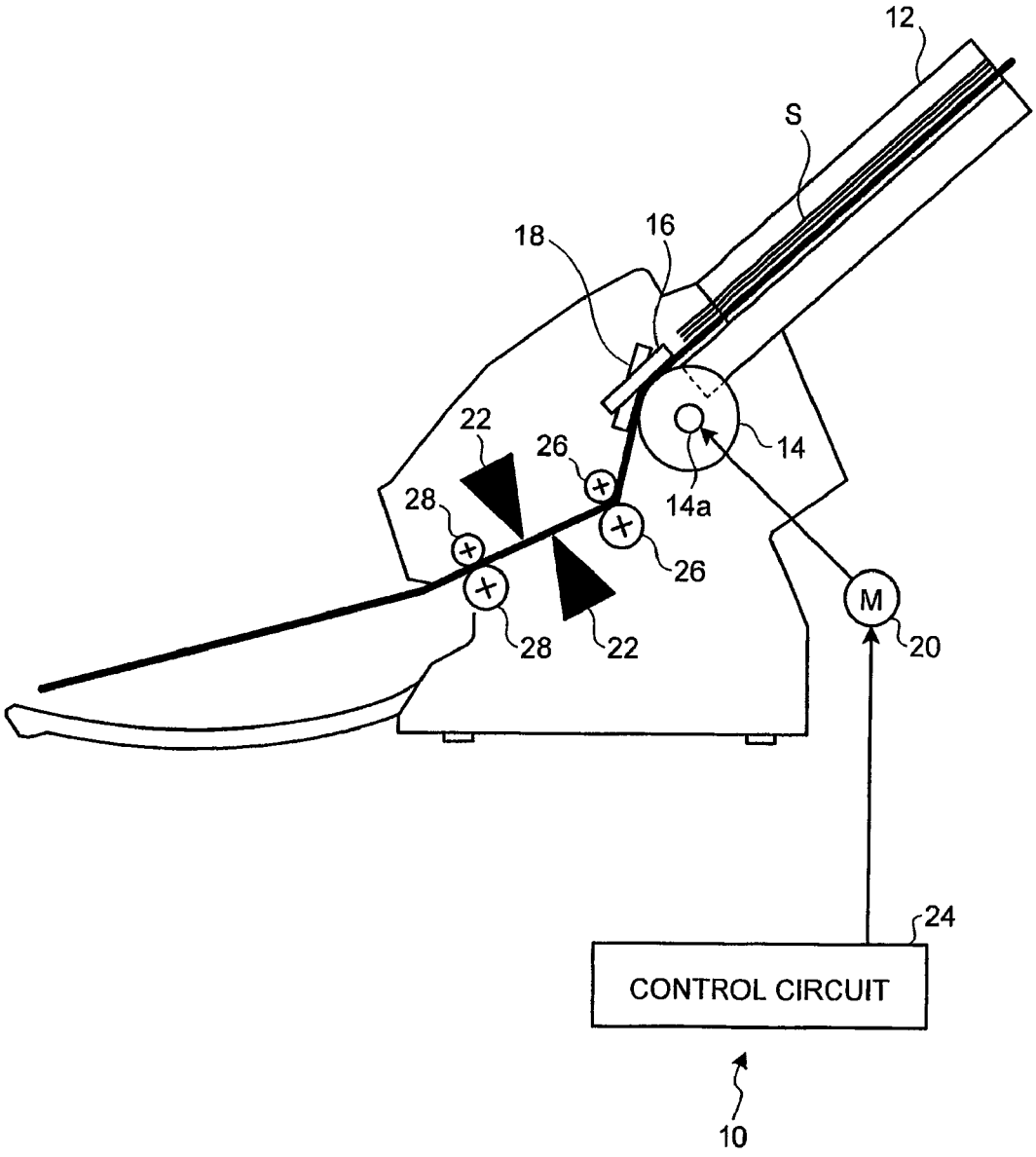
FIG. 1 is a cross-section view schematically depicting an image reading apparatus to which a feeding device according to a first embodiment of the present invention is applied.

A feeding device according to a first embodiment is explained below. FIG. 1 is a cross-section view schematically depicting an image reading apparatus to which the feeding device according to the first embodiment is applied. In the following, only the case where the feeding device is applied to the image reading apparatus is explained. However, this feeding device may be applied to an image forming apparatus, for example.

A feeding device 10 includes a tray 12, a pick roller 14, a first friction pad 16 as a first pressing unit, a second friction pad 18 as a second pressing unit, and a motor 20 as a rotation driving unit.

The tray 12 has sheet-like conveyance-target media S stacked thereon.

The pick roller 14 sends conveyance-target media S stacked on the tray 12 toward an imaging position of an imaging unit 22, such as a Charge Coupled Device (CCD). The pick roller 14 is mounted on a housing of the feeding device 10. The pick roller 14 has a rotating shaft 14*a* rotatably supported on the housing of the feeding device 10. With this, the pick roller 14 is rotatable about the rotating shaft 14*a*. Also, the rotating shaft 14*a* of the pick roller 14 is coupled to the motor 20. With this rotating shaft 14*a* receiving a rotation driving force from the motor 20, the pick roller 14 is rotated in a direction indicated by an arrow X, which is a rotating direction, depicted in FIG. 2. The pick roller 14 acts a conveyance force F onto one conveyed medium, which is a conveyance target in contact with the pick roller among the conveyance-target media S stacked on the tray 12, to send the conveyed medium toward a conveyance destination, the conveyance force F for sending the conveyed medium toward a conveyance destination, which is the imaging position of the imaging unit 22, with a pressing force being applied via the conveyed medium to a circumferential surface of the pick roller 14 in a rotating state by the first friction pad or the second friction pad 18. The pick roller 14 then sends the conveyed medium that makes contact with the pick roller 14 and has the conveyance force F acted thereon toward the imaging position of the imaging unit 22. The pick roller 14 has its outer perimeter surface made of compressible rubber, for example.

Figure 2:
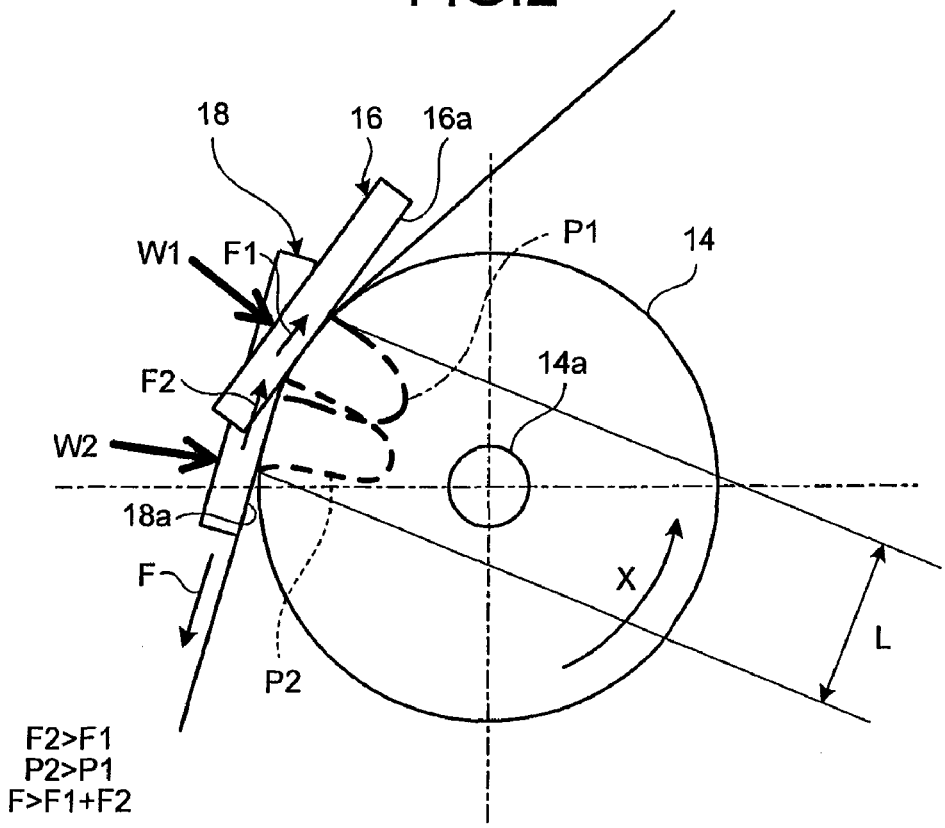
FIG. 2 is a side view of a pick roller, a first friction pad, and a second friction pad, depicting their positional relation.
Figure 3:
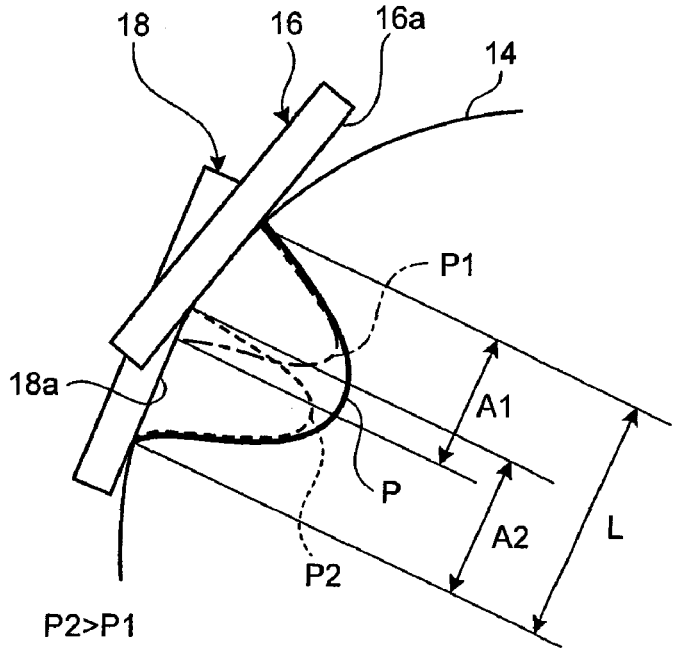
FIG. 3 is an enlarged view of main portions of FIG. 2.

As depicted in FIGS. 2 and 3, the first friction pad 16 presses the conveyed medium among the conveyance-target media S stacked on the tray 12 onto the circumferential surface of the pick roller 14, and inhibits a separation-target medium not as a conveyance target from being sent toward the imaging position of the imaging unit 22 as conveyance destination. The first friction pad 16 is formed in an approximately rectangular plate shape, for example. The first friction pad 16 is disposed so as to have one end surface in a plate-thickness direction, that is, a first contact surface 16*a*, face and make contact with the circumferential surface of the pick roller 14. Furthermore, the first friction pad 16 is fixed to the housing of the feeding device 10. With this housing, the first friction pad 16 has a first pressing force W1 applied thereto, the first pressing force W1 heading toward the inside in a diameter direction of the pick roller 14. Thus, the first friction pad 16 makes contact with the conveyance-target medium S, which is either one of the conveyed medium and a separation-target medium that is placed on the conveyed medium and is not a conveyance target, to press this conveyance-target medium S onto the circumferential surface of the pick roller 14 to apply the first pressing force W1 onto the circumferential surface of the pick roller 14. As such, with the first friction pad 16, a first contact area A1 where the first contact surface 16*a* of the first friction pad 16 and the circumferential surface of the pick roller 14 make contact with each other has an overall first-area pressing force P1 applied thereonto based on the first pressing forces W1. More specifically, this overall first-area pressing force P1 is a total of the first pressing forces W1. The first friction pad 16 acts a first separation force F1 smaller than the conveyance force F by the pick roller 14 onto the conveyance-target medium S that is in contact with the first friction pad 16 and is either one of the conveyed medium and the separation-target medium, in a direction opposite to the direction of the conveyance force F by the pick roller 14. The first friction pad 16 is made of metal, for example. Alternatively, the first friction pad 16 may be made of rubber.

Figure 4A:
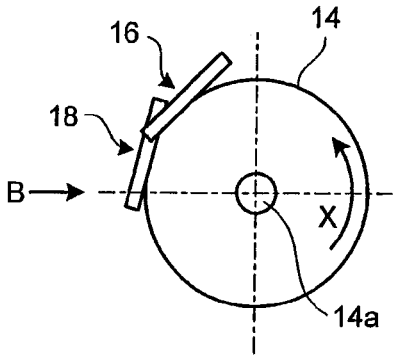
FIGS. 4A and 4B are drawings of one example, of an arrangement relation between first frication pads and a second friction pad.
Figure 4B:
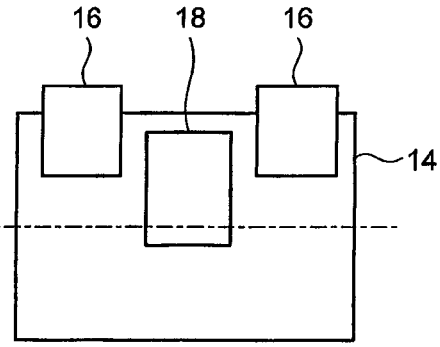
Figure 5A:
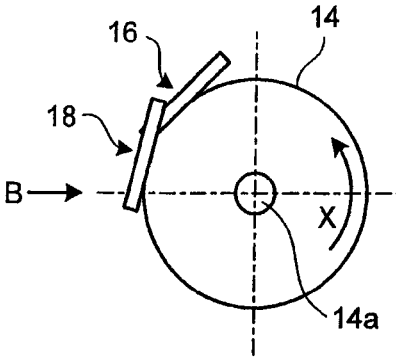
FIGS. 5A and 5B are drawings of another example of the arrangement relation between a first frication pad and second friction pads.
Figure 5B:
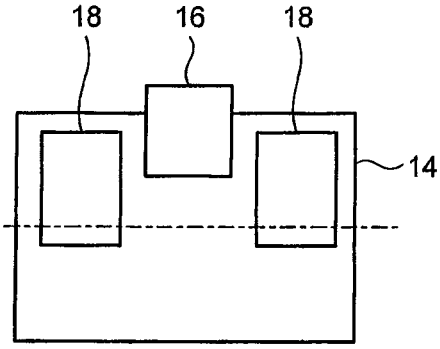

The second friction pad 18 makes the conveyed medium pressed onto the circumferential surface of the pick roller 14, and inhibits a separation-target medium not separated from the conveyed medium by the first friction pad 16 from being sent toward the imaging position of the imaging unit 22 as conveyance destination. The second friction pad 18 is formed in an approximately rectangular plate shape, for example. The second friction pad 18 is disposed on a downstream side of the first friction pad 16 along a rotating direction of the nick roller 14 as having one end surface in a plate-thickness direction, that is, a second contact surface 18*a*, face and make contact with the circumferential surface of the pick roller 14. Furthermore, the second friction pad 18 is fixed to the housing of the feeding device 10. With this housing, the second friction pad 18 has a second pressing force W2 applied thereto, the second pressing force W2 heading toward the inside in a diameter direction of the pick roller 14. Thus, the second friction pad 18 makes contact with the conveyance-target medium S, which is either one of the conveyed medium and the separation-target medium that is sent toward the imaging position of the imaging unit 22 as conveyance destination by the pick roller 14, to press this conveyance-target medium S onto the circumferential surface of the pick roller 14 to apply the second pressing force W2 onto the circumferential surface of the pick roller 14. As such, with the second friction pad 18, a second contact area A2 where the second contact surface 18*a* of the second friction pad 18 and the circumferential surface of the pick roller 14 make contact with each other has an overall second-area pressing force P2 applied thereonto based on the second pressing forces W2. More specifically, this overall second-area pressing force P2 is a total of the second pressing forces W2. The second friction pad 18 is disposed along the rotating direction of the pick roller 14 so that a first friction area A1, which is an area where the first contact surface 16*a* of the first friction pad 16 and the circumferential surface of the pick roller 14 make contact with each other, and a second friction area A2, which is an area where the second contact surface 18*a* of the second friction pad 18 and the circumferential surface of the pick roller 14 make contact with each other, overlap each other. In the first embodiment, the second friction pad 18 is disposed as being shifted along the axial direction of the pick roller 14 so as not to interfere with the first friction pad 16. The overall second-area pressing force P2 from the second friction pad 18 toward the pick roller 14 is set larger than the overall first-area pressing force P1 from the first friction pad 16 toward the pick roller 14. In more detail, for example, when the first and second friction pads 16 and 18 are made of the same member, the first and second friction pads 16 and 18 are fixed so that the distance between a portion of the second friction pad 18 that makes contact with the circumferential surface of the pick roller 14 and the rotating shaft 14*a* of the pick roller 14 is shorter than the distance between a portion of the first friction pad 16 that makes contact with the circumferential surface of the pick roller 14 and the rotating shaft 14*a* of the pick roller 14. The second friction pad 18 as explained above acts a second separation force F2 smaller than the conveyance force F by the pick roller 14 onto the conveyance-target medium S that is in contact with the second friction pad 18 and is either one of the conveyed medium and the separation-target medium, in a direction opposite to the direction of the conveyance force F by the pick roller 14. As depicted in FIGS. 4A and 4B, in the first embodiment, the number of second friction pads 18 provided is smaller than the number of first friction pads 16. In more detail, in the first embodiment, two first friction pads 16 and one second friction pad 18 are disposed, with the one second friction pad 18 being interposed between the two first friction pads 16. FIG. 4B is a view when the pick roller 14 and the first and second friction pads 16 and 18 are viewed from a direction indicated by an arrow B toward the inside of a diameter direction of the pick roller 14 in FIG. 4A. In another example, as depicted in FIGS. 5A and 5B, the number of second friction pads 18 disposed may be larger than the number of first friction pads 16. In more detail, in the example depicted in FIGS. 5A and 5B, one first friction pad 16 and two second friction pads 18 are disposed, with the two second friction pads 18 having the one first friction pad 16 interposed therebetween. FIG. 5B is a view when the pick roller 14 and the first and second friction pads 16 and 18 are viewed from a direction indicated by the arrow B toward the inside of the diameter direction of the pick roller 14 in FIG. 5A. The second friction pad 18 as explained above is made of metal, for example. Alternatively, the second friction pad 18 may be made of rubber.

As depicted in FIG. 3, an overall pressing force P, which is a total of the overall first-area pressing force P1 and the overall second-area pressing force P2, is successive in a total contact area L, which is a total of the first contact area A1 and the second contact area A2 along the direction in which the pick roller rotates. Also, the overall pressing force P is maximum at an approximately center portion of the total contact area L, which is a portion where the first contact area A1 and the second contact area A2 overlap each other. At that portion of the total contact area L where the overall pressing force P is maximum, a separation force, that is, a total of the first separation force F1 and the second separation force F2, is maximum.

The motor 20 drives the pick roller 14 for rotation. The motor 20 is coupled to the rotating shaft 14*a* of the pick roller 14. Upon reception of power from a control circuit 24, the motor 20 provides a rotation driving force to the rotating shaft 14*a* of the pick roller 14 to rotate the pick roller 14.

The conveyance-target media S are assumed to be paper sheets, overhead projector (OHP) sheets, and the like, for example. In FIG. 1, a line passing from the tray 12 to a space between the pick roller 14 and the first and second friction pads 16 and 18 and further to a space between conveyer rollers 26 in pair and then a space between delivery rollers 28 in pair represents a conveyor path, which is a movement path of the conveyance-target media S.

Next, the operation of the feeding device 10 according to the first embodiment is explained.

With the conveyance-target media S being stacked on the tray 12 of the feeding device 10, when a scan switch not shown of the image reading apparatus is pressed, a start instruction for scanning the conveyance-target medium S is input to the control circuit 24 to cause power to be supplied from the control circuit 24 to the motor 20. As a result, the motor 20 is driven for rotation to cause a rotation driving force to be transferred from the motor 20 to the rotating shaft 14*a* of the pick roller 14, thereby rotating the pick roller 14 in its rotating direction (a direction indicated by an arrow X). In this manner, a process of the feeding device 10 sending the conveyance-target medium S is started.

In the feeding device 10, the first and second friction pads 16 and 18 are disposed on the circumferential surface of the pick roller 14 so that the first contact area A1 and the second contact area A2 overlap each other. Therefore, the conveyance-target medium S, which is either one of the conveyed medium and the separation-target medium, has applied thereonto the first and second pressing forces W1 and W2 as pressing forces successively by the first and second friction pads 16 and 18 from the first contact area A1 to the second contact area A2, that is, along the direction in which the pick roller 14 rotates, in the total contact area L depicted in FIG. 2. In other words, the conveyance-target medium S, which is either one of the conveyed medium and the separation-target medium, has applied thereonto the first and second pressing forces W1 and W2 as pressing forces successively by the first and second friction pads 16 and 18 along the direction in which the pick roller 14 rotates in the total contact area L wider than an area when the pressing force is applied only in the first contact area A1 or the second contact area A2. Therefore, the conveyance-target medium S, which is either one of the conveyed medium and the separation-target medium, receives the first and second separation forces F1 and F2 as separation forces successively in an area wider than an area when a separation force is applied only in the first contact area A1 or the second contact area A2. Therefore, the capability of separating the conveyed medium and the separation-target medium can be increased. Also, for this reason, a conveyance jam of the conveyance-target medium S at the time of feeding can be suppressed.

Also, in the feeding device 13, when receiving the overall pressing force P, which is a total of the overall first-area pressing force P1 and the overall second-area pressing force P2 from the first and second friction pads 16 and 18, the conveyance-target medium S receives the overall second-area pressing force P2 from the second friction pad 18 on a downstream side along the direction in which the pick roller 14 rotates, the overall second-area pressing force P2 being larger than the overall first-area pressing force P1 received from the first friction pad 16 on an upstream side. In other words, the overall first-area pressing force P1 from the first friction pad 16 on the upstream side toward the conveyance-target medium S is weaker than the overall second-area pressing force P2 from the second friction pad 18 on the downstream side. Therefore, the conveyance-target medium S, which is either one of the conveyed medium and the separation-target medium, can be introduced to a space between the first friction pad 16 and the pick roller 14 on the upstream side easier than to a space between the second friction pad 18 and the pick roller 14 on the downstream side. In addition, even if the conveyed medium and the separation-target medium cannot be successfully separated by the first friction pad 16, the overall second-area pressing force P2 larger than the overall first-area pressing force P1 is provided to the conveyed medium and the separation-target medium in the second contact area A2. Therefore, when the conveyance-target medium S, which is either one of the conveyed medium and the separation-target medium, is to be sent by the pick roller 14 to the imaging position of the imaging unit 22 as a conveyance destination, the conveyed medium and the separation-target medium can be reliably separated by the second friction pad 18.

Furthermore, in the feeding device 10 according to the first embodiment, along the direction in which the pick roller 14 rotates, the number of first friction pads 16 on the upstream side is larger than the number of second friction pads 18 on the downstream side. Therefore, on the upstream side, along the axial direction of the pick roller 14, the conveyance-target medium S can be pressed by the plurality of first friction pads 16 onto the circumferential surface of the pick roller 14 at positions more than those on the downstream side. With this, the conveyance-target medium S can be stably sent by the pick roller 14. For example, a conveyance jam of the conveyance-target medium S in contact with the second friction pad 18 on the downstream side can be more suppressed.

Still further, in the feeding device 10 according to the first embodiment, for example, when the overall first-area pressing force P1 is fixed at a constant value, with an increase in the number of first friction pads 16, the surface pressure by the first friction pads 16 onto the pick roller 14 can be reduced. Therefore, a coefficient of static friction of the first separation force F1 to be provided from each first friction pad 16 to the conveyance-target medium S can be increased. This can increase the capability of separating the conveyed medium and the separation-target medium.

Figure 6:
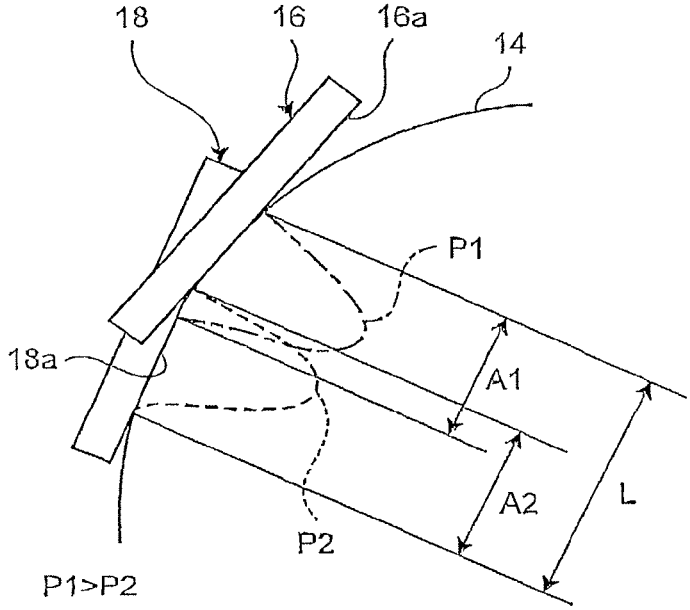
FIG. 6 is a drawing depicting an example different from FIG. 3 in magnitude between a total of first pressing forces and a total of second pressing forces, corresponding to FIG. 3.

In the first embodiment, it is assumed that the overall second-area pressing force P2 from the second friction pad 18 toward the pick roller 14 is set larger than the overall first-area pressing force P1 from the first friction pads 16 toward the pick roller 14. However, the present invention is not meant to be restricted to this. Alternatively, as depicted in FIG. 6 for example, in the present invention, the overall second-area pressing force P2 from the second friction pad 18 toward the pick roller 14 may be set smaller than the overall first-area pressing force P1 from the first friction pads 16 toward the pick roller 14. In more detail, when the first and second friction pads 16 and 18 are made of the same members, for example, the first and second friction pads 16 and 18 can be fixed so that the distance between the portion of the second friction pad 18 that makes contact with the circumferential surface of the pick roller 14 and the rotating shaft 14*a* of the pick roller 14 is longer than the distance between the portion of the first friction pad 16 that makes contact with the circumferential surface of the pick roller 14 and the rotating shaft 14*a* of the pick roller 14. Alternatively, in the present invention, the overall second-area pressing force P2 from the second friction pad 18 toward the pick roller 14 may be set equal to the overall first-area pressing force P1 from the first friction pads 16 toward the pick roller 14. In more detail, when the first and second friction pads 16 and 18 are made of the same members, for example, the first and second friction pads 16 and 18 can be fixed so that the distance between the portion of the second friction pad 18 that makes contact with the circumferential surface of the pick roller 14 and the rotating shaft 14*a* of the pick roller 14 is equal to the distance between the portion of the first friction pad 16 that makes contact with the circumferential surface of the pick roller 14 and the rotating shaft 14*a* of the pick roller 14. In any case, the conveyance-target medium S, which is either one of the conveyed medium and the separation-target medium, successively receives the separation force including the first and second separation forces F1 and F2 in the total contact area L wider than an area when the separation force is received only in the first contact area A1 or the second contact area A2. With this, the capability of separating the conveyed medium and the separation-target medium can be increased. Also, for this reason, a conveyance jam of the conveyance-target medium S at the time of feeding can be suppressed.

Figure 7:
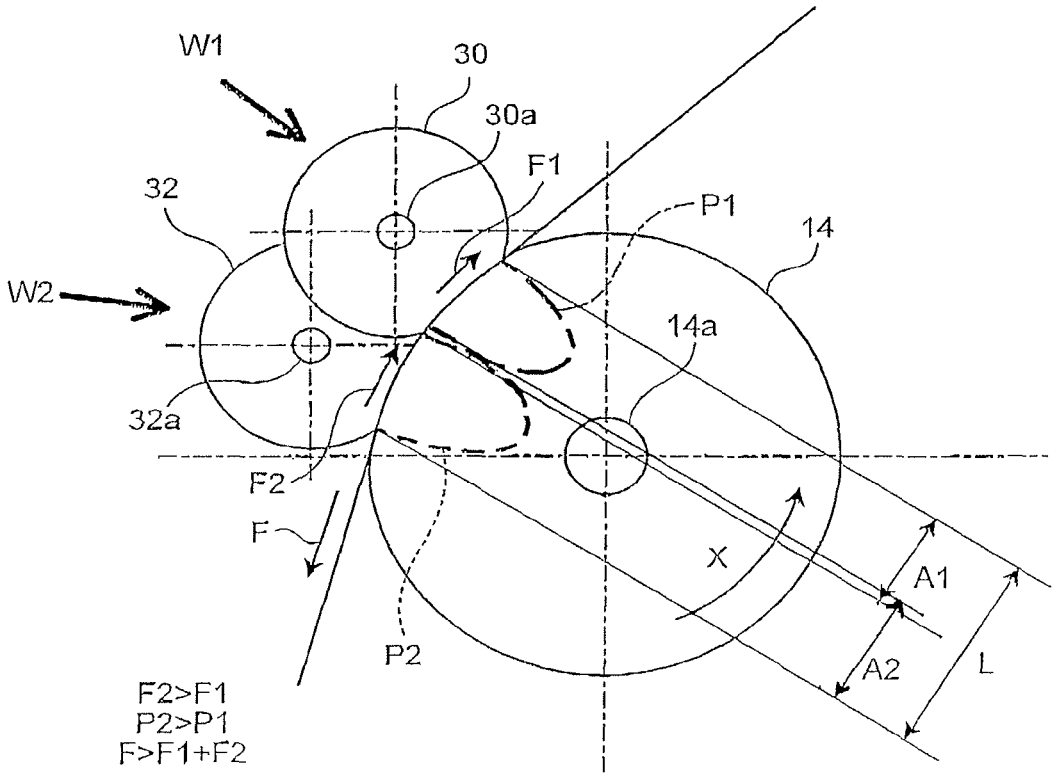
FIG. 7 is a side view of a pick roller, a first friction pad, and a second friction pad, depicting their positional relation according to a second embodiment of the present invention.

A feeding device according to a second embodiment is explained below. FIG. 7 is a side view schematically depicting the feeding device according to the second embodiment. Note that components similar to those in the first embodiment are provided with the same reference numerals and a redundant explanation thereof is omitted.

A first pressing unit according to the second embodiment is a first separation roller 30. The first separation roller 30 has an axial direction parallel to the axial direction of the pick roller 14. The first separation roller 30 is disposed with its circumferential surface facing and making contact with the circumferential surface of the pick roller 14. The first separation roller 30, with its circumferential surface being in contact with the circumferential surface of the pick roller 14, applies the first pressing force W1, which will be explained further below, onto the circumferential surface of the pick roller 14. The first separation roller 30 is mounted on the housing of the feeding device 10. The first separation roller 30 has a rotating shaft 30*a* rotatably supported on the housing of the feeding device 10. The pick roller 14 is rotatable about the rotating shaft 30*a*. Therefore, when the pick roller 14 rotates, the first separation roller 30 receives a torque from the pick roller 14.

Furthermore, the rotating shaft 30*a* of the first separation roller 30 has mounted thereon a torque limiter not shown. When a torque smaller than a predetermined value is applied around the rotating shaft 30*a*, the first separation roller 30 sustains a rotation stop state. When the torque applied around the rotating shaft 30*a* reaches the predetermined value, the first separation roller 30 rotates in a direction in which this torque is applied. In this manner, the first separation roller 30 is rotatable in a direction opposite to the direction in which the pick roller 14 rotates. Alternatively, this first separation roller 30 may be configured to rotate in a direction opposite to the direction in which the pick roller 14 rotates upon reception of a rotation driving force from the motor not shown. Furthermore, to the first separation roller 30, the first pressing force W1 heading toward the inside of the diameter direction of the pick roller 14 is applied by the housing of the feeding device 10. Therefore, the first separation roller 30 makes contact with the conveyance-target medium S, which is either one of the conveyed medium and the separation-target medium that is placed on the conveyed medium and is not a conveyance target, to press this conveyance-target medium S onto the circumferential surface of the pick roller 14 to apply the first pressing force W1 onto the circumferential surface of the pick roller 14. In this manner, with the first separation roller 30, the overall first-area pressing force P1 based on the first pressing forces W1 is applied to the first contact area A1 where the circumferential surface of the first separation roller 30 and the circumferential surface of the pick roller 14 make contact with each other. In more detail, the overall first-area pressing force P1 is a total of the first pressing forces W1. The first separation roller 30 then acts the first separation force F1 smaller than the conveyance force F from the pick roller 14 toward the conveyance-target medium S that is in contact with the first separation roller 30 and is either one of the conveyed medium and the separation-target medium, in a direction opposite to the direction of the conveyance force F from the pick roller 14. The first separation roller 30 has its outer perimeter surface made of compressible rubber, for example.

Figure 8A:
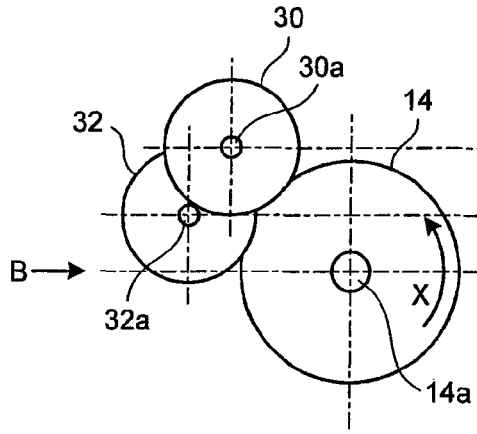
FIGS. 8A and 8B are drawings of an example of an arrangement relation between first separation rollers and a second separation roller.
Figure 8B:
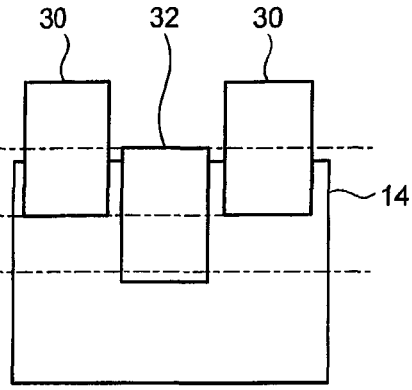
Figure 9A:
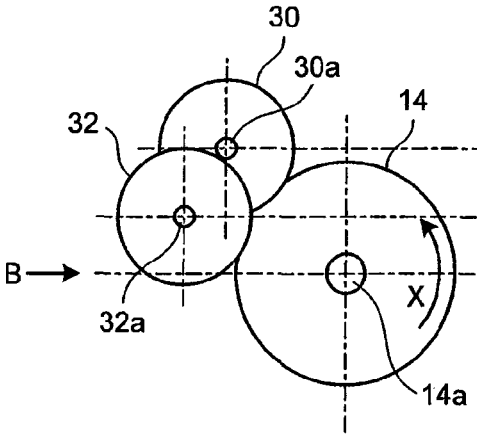
FIGS. 9A and 9B are drawings of another example of the arrangement relation between a first separation roller and second separation rollers.
Figure 9B:
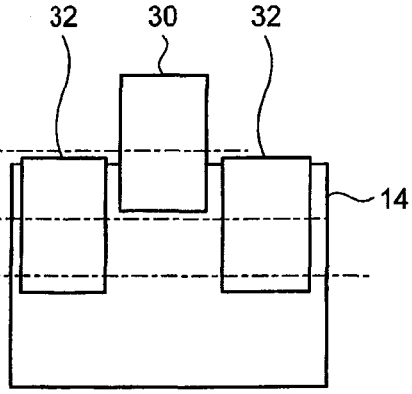

A second pressing unit according to the second embodiment is a second separation roller 32. The second separation roller 32 has an axial direction parallel to the axial direction of the pick roller 14. The second separation roller 32 is disposed on a downstream side of the first separation roller 30, which is the first pressing unit, along the direction in which the pick roller 14 rotates, with the circumferential surface of the second separation roller 32 facing and making contact with the circumferential surface of the pick roller 14. The second separation roller 32, with its circumferential surface being in contact with the circumferential surface of the pick roller 14, applies the second pressing force W2, which will be explained further below, onto the circumferential surface of the pick roller 14. The second separation roller 32 is mounted on the housing of the feeding device 10. The second separation roller 32 has a rotating shaft 32*a* rotatably supported on the housing of the feeding device 10. The pick roller 14 is rotatable about the rotating shaft 32*a*. Therefore, when the pick roller 14 rotates, the second separation roller 32 receives a torque from the pick roller 14. Furthermore, the rotating shaft 32*a* of the second separation roller 32 has mounted thereon a torque limiter not shown. When a torque smaller than a predetermined value is applied around the rotating shaft 32*a*, the second separation roller 32 sustains a rotation stop state. When the torque applied around the rotating shaft 32*a* reaches the predetermined value, the second separation roller 32 rotates in a direction in which this torque is applied. In this manner, the second separation roller 32 is rotatable in a direction opposite to the direction in which the pick roller 14 rotates. Alternatively, this second separation roller 32 may be configured to rotate in a direction opposite to the direction in which the pick roller 14 rotates upon reception of a rotation driving force from the motor not shown. Furthermore, to the second separation roller 32, the second pressing force W2 heading toward the inside of the diameter direction of the pick roller 14 is applied by the housing of the feeding device 10. Therefore, the second separation roller 32 makes contact with the conveyance-target medium S, which is either one of the conveyed medium and the separation-target medium that is placed on the conveyed medium and is not a conveyance target, to press this conveyance-target medium S onto the circumferential surface of the pick roller 14 to apply the second pressing force W2 onto the circumferential surface of the pick roller 14. In this manner, with the second separation roller 32, the overall second-area pressing force P2 based on the second pressing forces W2 is applied to the second contact area A2 where the circumferential surface of the second separation roller 32 and the circumferential surface of the pick roller 14 make contact with each other. In more detail, the overall second-area pressing force P2 is a total of the second pressing forces W2. The second separation roller 32 is disposed so that the first separation roller 30 and the second separation roller 32 are disposed so as to overlap each other when viewed from the axial direction of the pick roller 14. In the second embodiment, the second separation roller 32 is disposed as being shifted along the axial direction of the pick roller 14 so as not to interfere with the first separation roller 30. When viewed from the axial direction of the pick roller 14, a distance between the axis of the first separation roller 30 and the axis of the second separation roller 32 is shorter than a total length of the diameter of the first separation roller 30 and the diameter of the second separation roller 32. As a result, the second separation roller 32 allows, along the direction in which the pick roller 14 rotates, the first contact area A1, which is an area where the circumferential surface of the first separation roller 30 and the circumferential surface of the pick roller 14 make contact with each other, and the second contact area A2, which is an area where the circumferential surface of the second separation roller 32 and the circumferential surface of the pick roller 14 make contact with each other, to be disposed as overlapping each other. The overall second-area pressing force P2 from the second separation roller 32 toward the pick roller 14 is set larger than the overall first-area pressing force P1 from the first separation roller 30 toward the pick roller 14. In more detail, for example, when the first and second separation rollers 30 and 32 are made of the same member, the first and second separation rollers 30 and 32 are fixed so that the distance between the rotating shaft 32*a* of the second separation roller 32 and the rotating shaft 14*a* of the pick roller 14 is shorter than the distance between the rotating shaft 30*a* of the first separation roller 30 and the rotating shaft 14*a* of the pick roller 14. The second separation roller 32 then acts the second separation force F2 smaller than the conveyance force F from the pick roller 14 toward the conveyance-target medium S that is in contact with the second separation roller 32 and is either one of the conveyed medium and the separation-target medium, in a direction opposite to the direction of the conveyance force F from the pick roller 14. As depicted in FIGS. 8A and 8B, the number of second separation rollers 32 provided is smaller than the number of first separation rollers 30. In more detail, in the second embodiment, two first separation rollers 30 and one second separation roller 32 are disposed, with the one second separation roller 32 being interposed between the two first separation rollers 30. FIG. 8B is a view when the pick roller 14 and the first and second separation rollers 30 and 32 are viewed from a direction indicated by an arrow B toward the inside of a diameter direction of the pick roller 14 in FIG. 8A. In another example, as depicted in FIGS. 9A and 9B, the number of second separation rollers 32 disposed may be larger than the number of first separation rollers 30. In more detail, in the example depicted in FIGS. 9A and 9B, one first separation roller 30 and two second separation rollers 32 are disposed, with the two second separation rollers 32 having the one first separation roller 30 interposed therebetween. FIG. 9B is a view when the pick roller 14 and the first and second separation rollers 30 and 32 are viewed from a direction indicated by the arrow B toward the inside of the diameter direction of the pick roller 14 in FIG. 9A. The second separation roller 32 has its outer perimeter surface made of compressible rubber, for example.

In the feeding device 10 according to the second embodiment, as with the first embodiment, the first and second contact areas A1 and A2 are continuous in the direction in which the pick roller 14 rotates. Therefore, the conveyance-target medium S, which is either one of the conveyed medium and the separation-target medium, receives the first and second pressing forces F1 and F2 as separation forces successively in the total contact area L, which is an area wider than an area when a separation force is applied only in the first contact area A1 or the second contact area A2. Therefore, the capability of separating the conveyed medium and the separation-target medium can be increased. Also, for this reason, a conveyance jam of the conveyance-target medium S at the time of feeding can be suppressed.

Also, in the feeding device 10 according to the second embodiment, when receiving the overall pressing force P, which is a total of the overall first-area pressing force P1 and the overall second-area pressing force P2 from the first and second separation rollers 30 and 32, the conveyance-target medium S receives the overall second-area pressing force P2 from the second separation roller 32 on a downstream side along the direction in which the pick roller 14 rotates, the overall second-area pressing force P2 being larger than the overall first-area pressing force P1 received from the first separation roller 30 on an upstream side. In other words, the overall first-area pressing force P1 from the first separation roller 30 on the upstream side toward the conveyance-target medium S is weaker than the overall second-area pressing force P2 from the second separation roller 32 on the downstream side. Therefore, the conveyance-target medium S, which is either one of the conveyed medium and the separation-target medium, can be introduced to a space between the first separation roller 30 on the upstream side and the pick roller 14 easier than to a space between the second separation roller 32 on the downstream side and the pick roller 14. In addition, even if the conveyed medium and the separation-target medium cannot be successfully separated by the first separation roller 30, the overall second-area pressing force P2 larger than the overall first-area pressing force P1 is provided to the conveyed medium and the separation-target medium in the second contact area A2. Therefore, when the conveyance-target medium S, which is either one of the conveyed medium and the separation-target medium, is to be sent by the pick roller 14 to the imaging position of the imaging unit 22 as a conveyance destination, the conveyed medium and the separation-target medium can be reliably separated by the second separation rollers 32.

Furthermore, in the feeding device 10 according to the second embodiment, the first and second separation rollers 30 and 32 are disposed so as to overlap each other when viewed from the axial direction of the pick roller 14. Therefore, the distance between the axis of the first separation roller 30 and the axis of the second separation roller 32 is shorter than the total length of the diameter of the first separation roller 30 and the diameter of the second separation roller 32. Thus, the overlapping portion between the first and second contact areas A1 and A2 in the direction in which the pick roller 14 rotates is larger than that in the case where the first and second separation rollers 30 and 32 are disposes so as not to overlap each other when viewed from the axial direction of the pick roller 14. As a result, along the direction in which the pick roller 14 rotates, in the overlapping portion between the first and second contact areas A1 and A2, a total of the first and second pressing forces W1 and W2, which is a pressing force from the first and second separation rollers 30 and 32 toward the conveyance-target medium S, which is either one of the conveyed medium and the separation-target medium, is larger than that in the case where the first and second separation rollers 30 and 32 are disposed so as not to overlap each other when viewed from the axial direction of the pick roller 14. With this, the capability of separating the conveyed medium and the separation-target medium can be more increased.

Still further, in the feeding device 10 according to the second embodiment, along the direction in which the pick roller 14 rotates, the number of first separation rollers 30 on the upstream side is larger than the number of second separation rollers 32 on the downstream side. Therefore, on the upstream side, along the axial direction of the pick roller 14, the conveyance-target medium S can be pressed by the plurality of first separation rollers 30 onto the circumferential surface of the pick roller 14 at positions more than those on the downstream side. With this, the conveyance-target medium S can be stably sent by the pick roller 14. For example, a conveyance jam of the conveyance-target medium S in contact with the second separation roller 32 on the downstream side can be more suppressed.

Still further, in the feeding device 10 according to the second embodiment, for example, when the overall first-area pressing force P1 is fixed at a constant value, with an increase in the number of first separation rollers 30, the surface pressure from the first separation rollers 30 onto the pick roller 14 can be reduced. Therefore, a coefficient of static friction of the first separation force F1 to be provided from each first separation roller 30 to the conveyance-target medium S can be increased. This can increase the capability of separating the conveyed medium and the separation-target medium.

Figure 10:
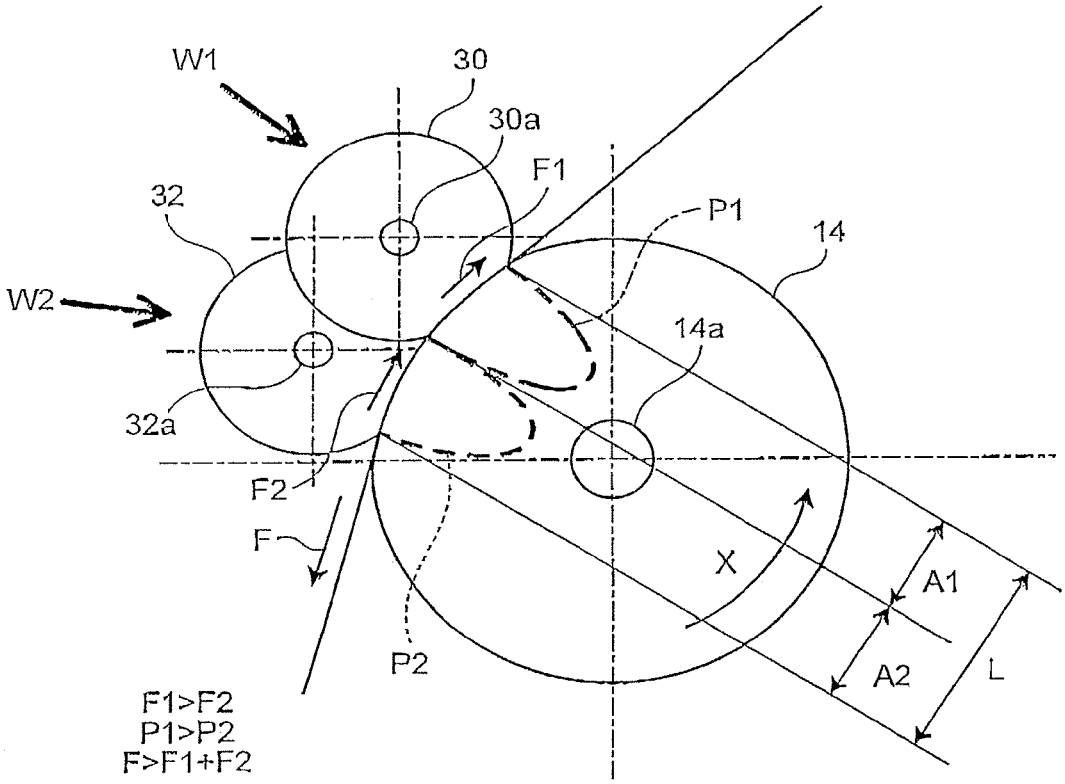
FIG. 10 is a drawing depicting an example different from FIG. 7 in magnitude between a total of first pressing forces and a total of second pressing forces, corresponding to FIG. 7.

In the second embodiment, it is assumed that the overall second-area pressing force P2 from the second separation roller 32 toward the pick roller 14 is set larger than the overall first-area pressing force P1 from the first separation rollers 30 toward the pick roller 14. However, the present invention is not meant to be restricted to this. Alternatively, as depicted in FIG. 10, for example, in the present invention, the overall second-area pressing force P2 from the second separation roller 32 toward the pick roller 14 may be set smaller than the overall first-area pressing force P1 from the first separation roller 30 toward the pick roller 14. In more detail, when the first and second separation rollers 30 and 32 are made of the same members, for example, the first and second separation rollers 30 and 32 can be fixed so that the distance between the rotating shaft 32*a* of the second separation roller 32 and the rotating shaft 14*a* of the pick roller 14 is set longer than the distance between the rotating shaft 30*a* of the first separation roller 30 and the rotating shaft 14*a* of the pick roller 14. Alternatively, in the present invention, the overall second-area pressing force P2 from the second separation rollers 32 toward the pick roller 14 may be set equal to the overall first-area pressing force P1 from the first separation rollers 30 toward the pick roller 14. In more detail, when the first and second separation rollers 30 and 32 are made of the same members, for example, the first and second separation rollers 30 and 32 can be fixed so that the distance between the rotating shaft 32*a* of the second separation roller 32 and the rotating shaft 14*a* of the pick roller 14 is set equal to the distance between the rotating shaft 30*a* of the first separation roller 30 and the rotating shaft 14*a* of the pick roller 14. In any case, the conveyance-target medium S, which is either one of the conveyed medium and the separation-target medium, successively receives the separation force including the first and second separation forces F1 and F2 in the total contact area L wider than an area when the separation force is received only in the first contact area A1 or the second contact area A2. With this, the capability of separating the conveyed medium and the separation-target medium can be increased. Also, for this reason, a conveyance jam of the conveyance-target medium S at the time of feeding can be suppressed.

Figure 11:
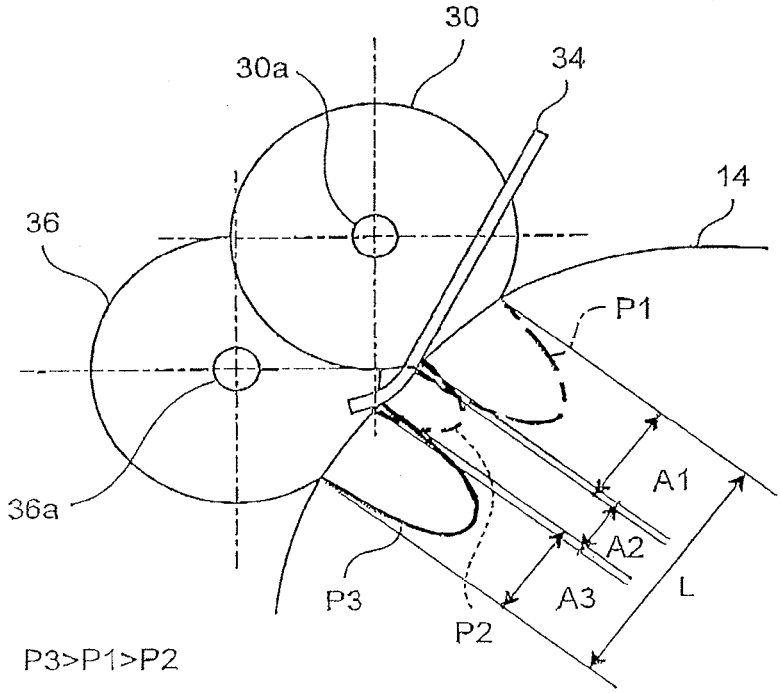
FIG. 11 is a side view of a pick roller, a first separation roller, a second friction pad, a third separation roller depicting their positional relation according to a third embodiment of the present invention.

A feeding device according to a third embodiment is explained below. FIG. 11 is a side view schematically depicting the feeding device according to the third embodiment. Note that components similar to those in the first and second embodiments are provided with the same reference numerals and a redundant explanation thereof is omitted.

A first pressing unit according to the third embodiment corresponds to the first separation roller 30 explained in the second embodiment.

A second pressing unit according to the third embodiment is a second friction pad 34. The basic structure and functions of this second friction pad 34 are identical to those of the second friction pad 18 explained in the first embodiment. However, a portion of the second friction pad 34 according to the third embodiment that makes contact with the pick roller 14 is curved so as to have a curvature center on the opposite side of the pick roller 14, and is slidable over the circumferential surface of the pick roller 14 with a second contact surface 34*a*, which corresponds to an end surface of the second friction pad 34 in a plate-thickness direction and faces the circumferential surface of the pick roller 14. On the other hand, an end of the second friction pad 34 according to the third embodiment on the opposite side of the slidable portion is fixed to, for example, the housing of an image reading apparatus to which the feeding device 10 is applied. This second friction pad 34 according to the third embodiment is a leaf spring, for example, but alternatively, may be an elastically-deformable rubber member or the like having at least a portion in contact with the pick roller 14 that can be bent almost along the plate-thickness direction.

Also, the feeding device 10 according to the third embodiment includes a third separation roller 36 as a third pressing unit. The third separation roller 36 presses the conveyed medium onto the pick roller 14 and inhibits the separation-target medium not separated by the second pressing unit, that is, the second friction pad 34 in the third embodiment, from the conveyed medium from being sent toward the imaging position of the imaging unit 22. The third separation roller 36 has an axial direction parallel to the axial direction of the pick roller 14. The third separation roller 36, with its circumferential surface being in contact with the circumferential surface of the pick roller 14, applies a third pressing force W3, which will be explained further below, onto the circumferential surface of the pick roller 14. The third separation roller 36, with its circumferential surface facing and making contact with the circumferential surface of the pick roller 14, is disposed on a downstream side of the second friction pad 34, which is the second pressing unit, along the rotating direction of the pick roller 14. The third separation roller 36 is mounted on the housing of the feeding device 10. The third separation roller 36 has a rotating shaft 36*a* rotatably supported on the housing of the feeding device 10. The pick roller 14 is rotatable about the rotating shaft 36*a*. Therefore, when the pick roller 14 rotates, the third separation roller 36 receives a torque from the pick roller 14. Furthermore, the rotating shaft 36*a* of the third separation roller 36 has mounted thereon a torque limiter not shown. When a torque smaller than a predetermined value is applied around the rotating shaft 36*a*, the third separation roller 36 sustains a rotation stop state. When the torque applied around the rotating shaft 36*a* reaches the predetermined value, the third separation roller 36 rotates in a direction in which this torque is applied. In this manner, the third separation roller 36 is rotatable in a direction opposite to the direction in which the pick roller 14 rotates. Alternatively, this third separation roller 36 may be configured to rotate in a direction opposite to the direction in which the pick roller 14 rotates upon reception of a rotation driving force from the motor not shown. Furthermore, to the third separation roller 36, the third pressing force W3 heading toward the inside of the diameter direction of the pick roller 14 is applied by the housing of the feeding device 10. Therefore, the third separation roller 36 makes contact with the conveyance-target medium S, which is either one of the conveyed medium and the separation-target medium that is placed on the conveyed medium and is not a conveyance target, to press this conveyance-target medium S onto the circumferential surface of the pick roller 14 to apply the third pressing force W3 onto the circumferential surface of the pick roller 14. In this manner, with the third separation roller 36, an overall third-area pressing force P3 based on the third pressing forces W3 is applied to a third contact area A3 where the circumferential surface of the third separation roller 36 and the circumferential surface of the pick roller 14 make contact with each other. In more detail, the overall third-area pressing force P3 is a total of the third pressing forces W3. When viewed from the axial direction of the pick roller 14, the third separation roller 36 is disposed so as to overlap the first separation roller 30. In the third embodiment, the third separation roller 36 is disposed as being shifted along the axial direction of the pick roller 14 so as not to interfere with the first separation roller 30. When viewed from the axial direction of the pick roller 14, a distance between the axis of the first separation roller 30 and the axis of the third separation roller 36 is shorter than a total length of the diameter of the first separation roller 30 and the diameter of the third separation roller 36. However, along the rotating direction of the pick roller 14, the third contact area A3, which is an area where the circumferential surface of the third separation roller 36 and the circumferential surface of the pick roller 14 make contact with each other, does not overlap the first contact area A1, which is an area where the circumferential surface of the first separation roller 30 and the circumferential surface of the pick roller 14 make contact with each other. Furthermore, the third separation roller 36 is disposed so that, along the rotating direction of the pick roller 14, the second contact area A2, which is an area where the second contact surface 34*a* of the second friction pad 34 and the circumferential surface of the pick roller 14 make contact with each other, and the third contact area A3, which is an area where the circumferential surface of the third separation roller 36 and the circumferential surface of the pick roller 14 make contact with each other, overlap each other. In the third embodiment, the third separation roller 36 is disposed as being shifted along the axial direction of the pick roller 14 so as not to interfere with the second friction pad 34. The overall third-area pressing force P3 from the third separation roller 36 toward the pick roller 14 is set larger than the overall first-area pressing force P1 from the first separation roller 30 toward the pick roller 14. In more detail, for example, when the first and third separation rollers 30 and 36 are made of the same member, the first and third separation rollers 30 and 36 are fixed so that the distance between the rotating shaft 36*a* of the third separation roller 36 and the rotating shaft 14*a* of the pick roller 14 is shorter than the distance between the rotating shaft 30*a* of the first separation roller 30 and the rotating shaft 14*a* of the pick roller 14. The third separation roller 36 acts a third separation force F3 smaller than the conveyance force F from the pick roller 14 toward the conveyance-target medium S that is in contact with the third separation roller 36 and is either one of the conveyed medium and the separation-target medium, in a direction opposite to the direction of the conveyance force F from the pick roller 14. The number of third separation rollers 36 disposed is smaller than the number of first separation rollers 30. In more detail, in the third embodiment, two first separation rollers 30 and one third separation roller 36 are disposed, with the one third separation roller 36 being interposed between the two first separation rollers 30. Note that the third separation roller 36 and the second separation roller 32 explained in the second embodiment are functionally identical to each other. The arrangement relation between two first separation rollers 30 and one third separation roller 36 is similar to the arrangement relation between two first separation rollers 30 and one second separation roller 32 explained in the second embodiment (however, in the third embodiment, the third contact area A3 does not overlap the first contact area A1 along the rotating direction of the pick roller 14), and is therefore not depicted in any drawing. In another example, the number of third separation rollers 36 disposed may be larger than the number of first separation rollers 30. In more detail, in an example where the number of third separation rollers 36 disposed is larger than the number of first separation rollers 30, one first separation roller 30 and two third separation rollers 36 are disposed. These two third separation rollers 36 are disposed sc as to interpose the one first separation roller 30. The arrangement relation between one first separation roller 30 and two third separation rollers 36 in this example is similar to the arrangement relation between one first separation roller 30 and two second separation rollers 32 explained in the second embodiment (however, in the third embodiment, the third contact area A3 does not overlap the first contact area A1 along the rotating direction of the pick roller 14), and is therefore not depicted in any drawing. The third separation roller 36 has its outer perimeter surface made of compressible rubber, for example.

In the feeding device 10 according to the third embodiment, the first separation roller 30 and the second friction pad 34 are disposed on the circumferential surface of the pick roller 14 so that the first and second contact areas A1 and A2 overlap each other, and also the third separation roller 36 is disposed on the circumferential surface of the pick roller 14 so that the second and third contact areas A2 and A3 overlap each other. Therefore, to the conveyance-target medium S, which is either one of the conveyed medium and the separation-target medium, the first pressing force W1, the second pressing force W2, and the third pressing force W3 as the pressing force are successively applied by the first separation roller 30, the second friction pad 34, and the third separation roller 36 from the first contact area A1 to the second contact area A2 and further to the third contact area A3. In other words, the conveyance-target medium S, which is either one of the conveyed medium and the separation-target medium, receives the first, second, and third pressing forces W1, W2, and W3 as pressing forces successively in the total contact area L, which is an area wider than an area when a pressing force is applied only in the first contact area A1, the second contact area A2, or the third contact area A3. For this reason, the conveyance-target medium S, which is either one of the conveyed medium and the separation-target medium, receives the first, second, and third separation forces F1, F2, and F3 as separation forces successively in the total contact area L, which is an area wider than an area when a separation force is applied only in the first contact area A1, the second contact area A2, or the third contact area A3. Therefore, the capability of separating the conveyed medium and the separation-target medium can be more increased.

Figure 12:
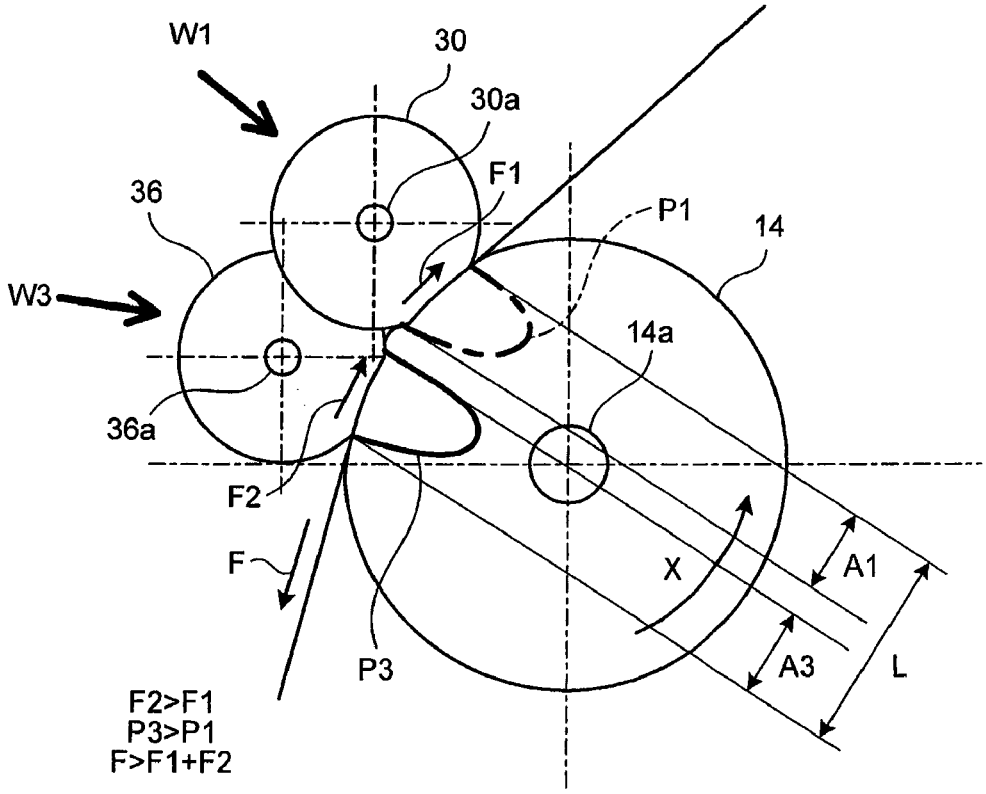
FIG. 12 is a side view of the first separation roller and the third separation roller, depicting their positional relation in FIG. 11.

In the feeding device 10 according to the third embodiment, the first and third separation rollers 30 and 36 as separation rollers are applied to the first and third pressing units. In other words, along the rotating direction of the pick roller 14, the first and third separation rollers 30 and 36 are disposed on upstream and downstream sides, respectively. As depicted in FIG. 12, even if the first and third separation rollers 30 and 36 are not disposed on the circumferential surface of the pick roller 14 so that the first and third contact areas A1 and A3 overlap each other along the rotating direction of the pick roller 14, the second friction pad 34 is disposed on the circumferential surface of the pick roller 14 so that the second contact area A2, which is an area where the second contact surface 34*a* of the second friction pad 34 and the circumferential surface of the pick roller 14 make contact with each other, overlaps both of the first and third contact areas A1 and A3. With this, continuity between the first and third contact areas A1 and A3 can be ensured. For this reason, the conveyance-target medium S, which is either one of the conveyed medium and the separation-target medium, receives the first, second, and third separation forces F1, F2, and F3 as separation forces successively in the total contact area L, which is an area wider than an area when a separation force is applied only in the first contact area A1 or the third contact area A3. Therefore, the capability of separating the conveyed medium and the separation-target medium can be more increased.

Figure 13:
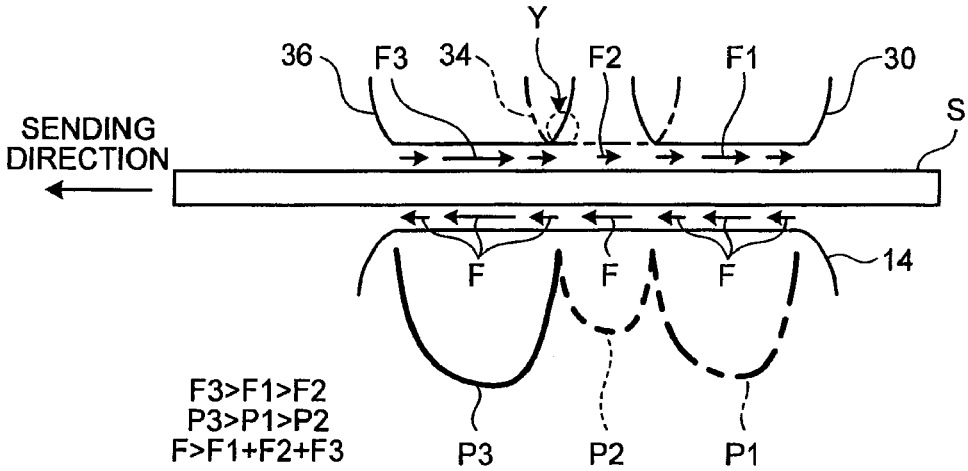

Also, the occurrence of a conveyance jam of the conveyance-target medium S between the first and third separation rollers 30 and 36, in particular, on a first contact area A1 side of the third contact area A3 (refer to a portion indicated by an arrow Y in FIG. 13). Note in FIG. 13 that the lengths of arrows F, F1, F2, and F3 each represent a magnitude of force at a position where the conveyance force or the separation force occurs.

Also, in the feeding device 10 according to the third embodiment, the first and third separation rollers 30 and 36 are disposed as overlapping each other when viewed from the axial direction of the pick roller 14. Therefore, even when the second pressing force W2 from the second friction pad 34 toward the conveyance-target medium S is smaller than the first pressing force W1 by the first separation roller 30 and the third pressing force W3 by the third separation roller 36 toward the conveyance-target medium S, a total of the first and second pressing forces W1 and W2 at the overlapping portion between the first and second contact areas A1 and A2 or a total of the third and second pressing forces W3 and W2 at the overlapping portion between the third and second contact areas A3 and A2 applied to the conveyance-target medium S along the rotating direction of the pick roller 14 can be more closer to the first pressing force W1 from the first separation roller 30 or the third pressing force W3 from the third separation roller 36 to the conveyance-target medium S. Thus, for example, at the overlapping portion between the first and second contact areas A1 and A2 and the overlapping portion between the third and second contact areas A3 and A2, the conveyance-target medium S can be stably conveyed with the rotation of the pick roller 14.

Furthermore, in the feeding device 10 according to the third embodiment, the number of first separation rollers 30 on the most upstream side is larger than the number of third-separation rollers 36 on the most downstream side along the rotating direction of the pick roller 14. Thus, on the most upstream side, the conveyance-target medium S can be pressed by the plurality of first separation rollers 30 along the axial direction of the pick roller 14 onto the circumferential surface of the pick roller 14 at more positions than those on the most downstream side. Thus, the conveyance-target medium S can be stably sent by the pick roller 14. For example, a conveyance jam of the conveyance-target medium S can be more suppressed when the conveyance-target medium S makes contact with the third separation roller 36 on the most downstream side.

Still further, in the feeding device 10 according to the third embodiment, for example, when the overall first-area pressing force P1 is fixed at a constant value, with an increase in the number of first separation rollers 30, the surface pressure by the first separation rollers 30 onto the pick roller 14 can be reduced. Therefore, a coefficient of static friction of the first separation force F1 to be provided from each first separation roller 30 to the conveyance-target medium can be increased. This can increase the capability of separating the conveyed medium and the separation-target medium.

Still further, in the feeding device 10 according to the third embodiment, when receiving the overall first-area and third-area pressing forces P1 and P3 by the first and third separation rollers 30 and 36, for example, the conveyance-target medium S receives the overall third-area pressing force P3 from the third separation roller 36 on the most downstream side along the rotating direction of the pick roller 14, the overall third-area pressing force P3 being larger than the overall first-area pressing force P1 from the first separation roller 30 on the most upstream side. In other words, the overall first-area pressing force P1 from the first separation roller 30 on the most upstream side toward the conveyance-target medium S is weaker than the overall third-area pressing force P3 from the third separation roller 36 on the most downstream side toward the conveyance-target medium S. Therefore, the conveyance-target medium S, which is either one of the conveyed medium and the separation-target medium, can be introduced to a space between the first separation roller 30 on the most upstream side and the pick roller 14 easier than to a space between the third separation roller 36 on the most downstream side and the pick roller 14. In addition, even if the conveyed medium and the separation-target medium cannot be successfully separated by the first separation roller 30, the overall third-area pressing force P3 larger than the overall first-area pressing force P1 is eventually provided to the conveyed medium and the separation-target medium in the third contact area A3. Therefore, when the conveyance-target medium S, which is either one of the conveyed medium and the separation-target medium, is to be sent by the pick roller 14 to the imaging position of the imaging unit 22 as a conveyance destination, the conveyed medium and the separation-target medium can be reliably separated by the third separation roller 36.

Figure 14:
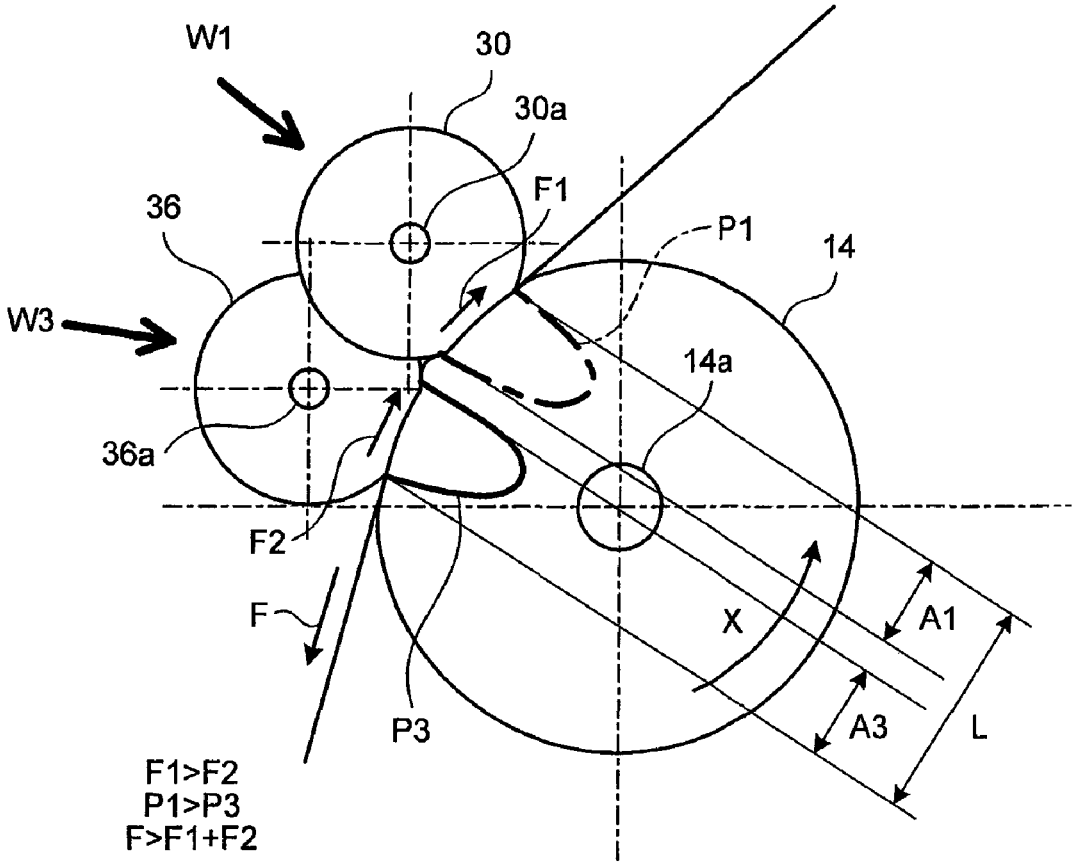
FIG. 14 is a drawing of an example different from FIG. 12 in magnitude between a total of first pressing forces and a total of third pressing forces, corresponding to FIG. 12.

In the third embodiment, it is assumed that the overall third-area pressing force P3 from the third separation roller 36 toward the pick roller 14 is set larger than the overall first-area pressing force P1 by the first separation rollers 30 to the pick roller 14. However, the present invention is not meant to be restricted to this. Alternatively, as depicted in FIG. 14 for example, in the present invention, the overall third-area pressing force P3 from the third separation roller 36 toward the pick roller 14 may be set smaller than the overall first-area pressing force P1 from first separation rollers 30 the toward the pick roller 14. In more detail, when the first and third separation rollers 30 and 36 are made of the same members, for example, the first and third separation rollers 30 and 36 can be fixed so that the distance between the rotating shaft 36*a* of the third separation roller 36 and the rotating shaft 14*a* of the pick roller 14 is longer than the distance between the rotating shaft 30*a* of the first separation roller 30 and the rotating shaft 14*a* of the pick roller 14. Alternatively, in the present invention, the overall third-area pressing force P3 from the third separation roller 36 toward the pick roller 14 may be set equal to the overall first-area pressing force P1 from the first separation rollers 30 toward the pick roller 14. In more detail, when the first and third separation rollers 30 and 36 are made of the same members, for example, the first and third separation rollers 30 and 36 can be fixed so that the distance between the rotating shaft 36*a* of the third separation roller 36 and the rotating shaft 14*a* of the pick roller 14 is equal to the distance between the rotating shaft 30*a* of the first separation roller 30 and the rotating shaft 14*a* of the pick roller 14. In any case, the conveyance-target medium S, which is either one of the conveyed medium and the separation-target medium, successively receives the separation force including the first, second, and third separation forces F1, F2, and F3 in the total contact area L wider than an area when the separation force is received only in the first contact area A1, the second contact area A2, or the third contact area A3. With this, the capability of separating the conveyed medium and the separation-target medium can be more increased.

In the third embodiment explained in the foregoing, the maximum value of the second pressing force W2 by the second friction pad 34 may be set at a value between the maximum value of the first pressing force W1 by the first separation roller 30 and the maximum value of the third pressing force W3 by the third separation roller 36. In this case, for example, by setting the conveyance force F, the first separation force F1, the second separation force F2, and the third separation force F3 so that these forces have a relation of F>F3>F2>F1, the conveyance-target medium S can be smoothly conveyed from the first contact area A1 to the second contact area A2 and from the second contact area A2 to the third contact area A3.

According to the embodiments of the present invention, the first pressing unit and the second pressing unit are disposed on the circumferential surface of the pick roller so that the first contact area and the second contact area overlap each other. Thus, to a conveyance-target medium that is either one of the conveyed medium and the separation-target medium, a pressing force is successively applied by the first pressing unit and the second processing unit over the first contact area to the second contact area. In other words, to the conveyance-target medium, which is either one of the conveyed medium and the separation-target medium, a pressing force is successively applied in an area wider than an area when a pressing force is applied only in either one of the first contact area and the second contact area. Thus, the conveyance-target medium, which is either one of the conveyed medium and the separation-target medium, successively receives a separation force in an area wider than an area when receiving a separation force only in either one of the first contact area and the second contact area. This can achieve an effect such that the capability of separating the conveyed medium and the separation-target medium can be increased.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A feeding device comprising:

a tray for stacking sheet-like conveyance-target media thereon;

a pick roller configured to apply a conveyance force onto a conveyed-target medium of a stack of conveyance-target media, the pick roller further configured to send the conveyed target medium toward a conveyance destination with a pressing force applied to a circumferential surface of the pick roller in a rotating state, wherein the pick roller is circular in shape without eccentricity, when viewed from an axial direction of the pick roller;

a first pressing unit including a first-pressing-unit separation roller having compressible outer perimeter surface, the first pressing unit being configured to face and apply a first pressing force onto the circumferential surface of the pick roller such that a circumferential surface of the first-pressing-unit separation roller and the circumferential surface of the pick roller make contact with each other to form a first contact area therebetween, and configured to make contact with either the conveyed-target medium or a separation-target medium disposed on the conveyed-target medium and to press the conveyance-target medium onto the circumferential surface of the pick roller to apply the first pressing force, the first pressing force being a first separation force smaller than a conveyance force applied by the pick roller, the first pressing force being in a direction opposite to a direction of the conveyance force;

a second pressing unit including a second-pressing-unit separation roller having compressible outer perimeter surface, the second pressing unit being disposed on a downstream side of the first pressing unit along a direction in which the pick roller rotates, the second pressing unit being configured to face the pick roller and to make contact with the circumferential surface of the pick roller such that a circumferential surface of the second-pressing-unit separation roller and the circumferential surface of the pick roller make contact with each other to form a second contact area therebetween, and configured to make contact with either the conveyed target medium or the separation-target medium, the second pressing unit configured to press the conveyed-target medium against the circumferential surface of the pick roller to apply a second pressing force onto the circumferential surface of the pick roller, the second pressing force being a second separation force smaller than the conveyance force and in the direction opposite to the direction of the conveyance force; and a rotation driving unit for rotating the pick roller;

wherein the first pressing unit and the second pressing unit are disposed along the direction in which the pick roller rotates;

wherein the first contact area is defined in which the first pressing unit and the pick roller make contact with each other, and the second contact area is defined in which the second pressing unit and the pick roller make contact with each other;

wherein the first pressing unit and the second pressing unit are disposed so that the first contact area and the second contact area appear to partly overlap each other when viewed from an axial direction of the pick roller; and wherein the first-pressing-unit separation roller has an axis parallel to the axial direction of the pick roller, and the first-pressing-unit separation roller is configured to sustain a rotation stop state when a torque smaller than a predetermined value is applied around the axis thereof, and to rotate, when the torque applied around the axis thereof reaches the predetermined value, in a direction opposite to the direction in which the pick roller rotates.

2. The feeding device according to claim 1, wherein the second-pressing-unit separation roller is fixed to apply the second pressing force onto the circumferential surface of the pick roller when the contact surface of the second-pressing-unit separation roller is in contact with the circumferential surface of the pick roller; and wherein the first-pressing-unit separation roller and the second-pressing-unit separation roller are disposed so as to overlap each other when viewed from the axial direction of the pick roller.

3. A feeding device comprising:

a pick roller configured to apply a conveyance force onto a conveyed-target medium of a stack of conveyance-target media, the pick roller further configured to send the conveyed target medium toward a conveyance destination with a pressing force applied to a circumferential surface of the pick roller in a rotating state, wherein the pick roller is circular in shape without eccentricity, when viewed from an axial direction of the pick roller;

a first pressing unit including a first-pressing-unit separation roller having compressible outer perimeter surface, the first pressing unit being configured to face and apply a first pressing force onto the circumferential surface of the pick roller such that a circumferential surface of the first-pressing-unit separation roller and the circumferential surface of the pick roller make contact with each other to form a first contact area therebetween, and configured to make contact with either the conveyed-target medium or a separation-target medium disposed on the conveyed-target medium and to press the conveyance-target medium onto the circumferential surface of the pick roller to apply the first pressing force, the first pressing force being a first separation force smaller than a conveyance force applied by the pick roller, the first pressing force being in a direction opposite to a direction of the conveyance force;

a second pressing unit including a second-pressing-unit separation roller having compressible outer perimeter surface, the second pressing unit being disposed on a downstream side of the first pressing unit along a direction in which the pick roller rotates, the second pressing unit being configured to face the pick roller and to make contact with the circumferential surface of the pick roller such that a circumferential surface of the second-pressing-unit separation roller and the circumferential surface of the pick roller make contact with each other to form a second contact area therebetween, and configured to make contact with either the conveyed target medium or the separation-target medium, the second pressing unit configured to press the conveyed-target medium against the circumferential surface of the pick roller to apply a second pressing force onto the circumferential surface of the pick roller, the second pressing force, being a second separation force smaller than the conveyance force and in the direction opposite to the direction of the conveyance force; and a rotation driving unit for rotating the pick roller;

wherein the first pressing unit and the second pressing unit are disposed along the direction in which the pick roller rotates;

wherein the first contact area is defined in which the first pressing unit and the pick roller make contact with each other, and the second contact area is defined in which the second pressing unit and the pick roller make contact with each other;

wherein the first pressing unit and the second pressing unit are disposed so that the first contact area and the second contact area appear to partly overlap each other when viewed from an axial direction of the pick roller; and wherein the first-pressing-unit separation roller has an axis parallel to the axial direction of the pick roller, and the first-pressing-unit separation roller is configured to sustain a rotation stop state when a torque smaller than a predetermined value is applied around the axis thereof, and to rotate, when the torque applied around the axis thereof reaches the predetermined value, in a direction opposite to the direction in which the pick roller rotates.

4. A feeding device comprising:

a pick roller configured to apply a conveyance force onto a conveyed-target medium of a stack of conveyance-target media, the pick roller further configured to send the conveyed target medium toward a conveyance destination with a pressing force applied to a circumferential surface of the pick roller in a rotating state, wherein the pick roller is circular in shape without eccentricity, when viewed from an axial direction of the pick roller;

a first pressing unit configured to face and apply a first pressing force onto the circumferential surface of the pick roller, and configured to make contact with either the conveyed-target medium or a separation-target medium disposed on the conveyed-target medium, the first pressing force being a first separation force smaller than a conveyance force applied by the pick roller, the first pressing force being in a direction opposite to a direction of the conveyance force;

a second pressing unit disposed on a downstream side of the first pressing unit along a direction in which the pick roller rotates, the second pressing unit facing the pick roller and configured to make contact with the circumferential surface of the pick roller and configured to make contact with either the conveyed target medium or the separation-target medium, the second pressing unit configured to press the conveyed-target medium against the circumferential surface of the pick roller to apply a second pressing force onto the circumferential surface of the pick roller, the second pressing force being a second separation force smaller than the conveyance force and in the direction opposite to the direction of the conveyance force; and a rotation driving unit for rotating the pick roller;

wherein the first pressing unit and the second pressing unit are disposed along the direction in which the pick roller rotates;

wherein a first contact area is defined in which the first pressing unit and the pick roller make contact with each other, and a second contact area is defined in which the second pressing unit and the pick roller make contact with each other;

wherein the first pressing unit and the second pressing unit are disposed so that, when viewed in an axial direction of the pick roller, the first contact area and the second contact area appear to partly overlap each other;

wherein the first pressing unit includes a first-pressing-unit separation roller having an axial direction in parallel to an axial direction of the pick roller and having a circumferential first contact surface that makes contact with the circumferential surface of the pick roller to apply the first pressing force onto the circumferential surface of the pick roller, and the first-pressing-unit separation roller is rotatable in a direction opposite to the direction in which the pick roller rotates;

wherein the feeding device further comprises a third pressing unit, disposed on a downstream side of the second pressing unit along the direction in which the pick roller rotates, for facing and applying a third pressing force onto the circumferential surface of the pick roller, the third pressing unit configured to make contact with either the conveyed-target medium or the separation-target medium, and further configured to send the conveyed-target medium; and wherein the second pressing unit includes a friction pad having a contact surface facing and making contact with the circumferential surface of the pick roller, the friction pad being fixed to apply the second pressing force onto the circumferential surface of the pick roller when the contact surface of the friction pad is in contact with the circumferential surface of the pick roller.

5. The feeding device according to claim 4, wherein the third pressing unit includes a third-pressing-unit separation roller having an axial direction in parallel to the axial direction of the pick roller and having a circumferential contact surface that makes contact with the circumferential surface of the pick roller for applying the third pressing force onto the circumferential surface of the pick roller, and the third-pressing-unit separation roller is rotatable in a direction opposite to the direction in which the pick roller rotates.

6. The feeding device according to claim 5, wherein the third-pressing-unit separation roller is disposed along the direction in which the pick roller rotates so that the contact surface between the friction pad and the pick roller, and a contact surface between the third-pressing-unit separation roller and the pick roller, overlap each other.

7. The feeding device according to claim 5, wherein the first-pressing-unit separation roller and the third-pressing-unit separation roller are disposed so as to overlap each other when viewed in the axis direction of the pick roller.

8. The feeding device according to claim 4, wherein a portion of the friction pad is curved to have a curvature center on a side opposite to the pick roller.

9. The feeding device accordingly to claim 4, wherein the second pressing unit includes a second-pressing-unit separation roller having a contact surface that faces and makes contact with the circumferential surface of the pick roller and is fixed to apply the second pressing force onto the circumferential surface of the pick roller when the contact surface of the second-pressing-unit separation roller is in contact with the circumferential surface of the pick roller; and wherein the first-pressing-unit separation roller and the second-pressing-unit separation roller are disposed so as to overlap each other when viewed in the axial direction of the pick roller.

10. The feeding device according to claim 4, wherein the third pressing unit is configured to apply a third separation force, smaller than the conveyance force, onto the conveyed-target medium in the direction opposite to the direction of the conveyance force.

* * * * *